US006105807A

United States Patent [19]

McCrossen

[11] Patent Number: 6,105,807

[45] Date of Patent: Aug. 22, 2000

[54] REMOVABLE SEALING CLOSURE WITH CLOSURE ATTACHMENT MEANS

[75] Inventor: Peter C McCrossen, Port Macquarie, Australia

[73] Assignee: Radley Valley Pty Limited, New South Wales, Australia

[21] Appl. No.: 09/242,335

[22] PCT Filed: Aug. 8, 1997

[86] PCT No.: PCT/AU97/00504

§ 371 Date: May 13, 1999

§ 102(e) Date: May 13, 1999

[87] PCT Pub. No.: WO98/06636

PCT Pub. Date: Feb. 19, 1998

[30] Foreign Application Priority Data

| | | | |
|---|---|---|---|
| Aug. 12, 1996 | [AU] | Australia | PO1560 |
| Sep. 25, 1996 | [AU] | Australia | PO2566 |
| Oct. 28, 1996 | [AU] | Australia | PO3288 |

[51] Int. Cl.[7] ..... B65D 41/08

[52] U.S. Cl. ..... 220/288; 220/304; 220/906

[58] Field of Search ..... 220/906, 319, 220/304, 288, 240, 254, 255, 256, 648, 649, 640, 641, 642, 643; 215/274, 276, 270, 271

[56] References Cited

U.S. PATENT DOCUMENTS

| | | | |
|---|---|---|---|
| 3,603,472 | 9/1971 | Lecinski et al. . | |
| 3,787,547 | 1/1974 | Stephan | 220/288 |
| 4,011,968 | 3/1977 | McGhie et al. . | |
| 4,844,270 | 7/1989 | Coffman | 220/319 X |
| 5,052,576 | 10/1991 | Budenbender | 220/304 |
| 5,785,198 | 7/1998 | Credle, Jr. | 220/254 |
| 5,881,907 | 3/1999 | Schutz | 220/648 X |
| 5,884,786 | 3/1999 | Valyi | 220/319 X |

FOREIGN PATENT DOCUMENTS

| | | | |
|---|---|---|---|
| 26385/ 49(1462)B | 4/1949 | Australia . | |
| 29766/84 | 6/1985 | Australia . | |
| 493151 | 5/1950 | Belgium | 220/304 |
| 715378 | 8/1965 | Canada | 220/288 |
| 29293 | 5/1981 | European Pat. Off. | 220/288 |
| 29293 A1 | 5/1981 | European Pat. Off. . | |
| 2480711 | 10/1981 | France . | |
| 2646831 A1 | 11/1990 | France . | |
| 490701 | 1/1930 | Germany | 220/288 |
| 1129077 | 5/1962 | Germany | 220/288 |
| 8-34457 | 2/1996 | Japan | 220/288 |
| 2012737 | 8/1979 | United Kingdom . | |

*Primary Examiner*—Nathan J. Newhouse
*Attorney, Agent, or Firm*—Nixon & Vanderhye

[57] ABSTRACT

A container (40) has a body (41) having an open end (42) surrounded by an outwardly and downwardly extending flange (43). A closure (44) is adapted to be sealed to the container body (41). The closure (44) has a flange clamping portion (48) such that when the closure (44) is mounted to the body (41), the flange clamping portion (48) forms a seal with at least the outer surface of the flange (43) by exerting pressure inwardly against the flange (43). The flange clamping portion (48) can also be adapted to form a seal with the open end (42) of the body (41) and the inner surface of the container body (41) proximate its open end (42). A thread ring (10) adapted to be mounted to the open end of a container is also described. The thread ring has a retaining means comprising a continuous hook (13) that is adapted to sealingly engage the open end of the container and so provide a means for closures to be readily and sealingly attached to containers.

19 Claims, 7 Drawing Sheets

REMOVABLE SEALING CLOSURE WITH CLOSURE ATTACHMENT MEANS

FIELD OF THE INVENTION

The present invention relates to closures for containers and container/closure combinations.

BACKGROUND ART

Metal containers and in particular steel and aluminium cans, have long been employed for the storage and transport of a wide range of products, including foods and beverages. One reason for the popularity of the can in relation to foods has been its ability to provide a sterile environment for the food product despite what can be significant storage times between filling of the can and ultimate consumption of the product by the consumer.

In the case of foods, heating in a steam pressurised retort is often utilised to cook the food and also ensure that a high enough temperature for a sufficient length of time is achieved to ensure that "commercial sterility" of the contents results. Cans for foods must remain hermetically sealed at temperatures as high as 130° C. retort pressures of more than 40 psi or vacuum pressures of the order of 4–5 inHg. The package should throughout this process and thereafter remain hermetically sealed until the time it is deliberately opened for consumption, and should remain effectively sterilised of pathogenic food spoilage organisms regardless of whether the food is served heated or not. The packaging that has met this requirement has typically been the non-resealable steel can which can withstand the high temperatures during the heat processing cycle and protect the contents against spoilage. Such cans have typically been opened by can openers that remove or puncture one end of the can to allow access to its contents. In more recent times, the use of ring-pull arrangements that allow one entire end of a can to be torn away from the can, and so removing the need for the use of a separate can opener, has also become more widespread.

Steel and aluminium cans have also proved ideal for containing carbonated liquids because of the can's ability to withstand the high internal pressures generated by carbonated liquids, such as soft drinks and beer (eg: pressures of about 96 psi and pasteurisation temperatures of around 60° C. are not uncommon). Such cans have typically had a ring-pull or similar mechanism that can be actuated to form a relatively small orifice in one end of the container. The traditional small orifice has a number of disadvantages, including that it cannot be resealed and that its dimensions slows the rate of consumption of the product in comparison with drinking the beverage from, for example, a glass or similar container. The small orifice also substantially prevents any aromas of the product being detected by the drinker which for many beverages, for example beer, detracts from the enjoyment of drinking the product.

The present invention is directed to an alternative mechanism for sealing the end of a container that retains the advantages of the present techniques whilst overcoming some of their disadvantages.

SUMMARY OF THE INVENTION

According to a first aspect, the present invention consists in a container comprising:

a body having an open end surrounded by a flange, the flange extending outwardly and towards an end of the body distal the open end;

a closure for the body comprising a top portion and a skirt extending outwardly from the top portion, an inner surface of the closure having a flange clamping area;

a closure attachment means mounted on the body proximate the flange;

the closure and closure attachment means having complementary engagement means such that on movement of the closure in one direction relative to the closure attachment means the complementary engagement means may engage to bring the container to a closed condition and on movement of the closure in another direction relative to the closure attachment means the complementary engagement means may disengage to bring the container to an opened condition; and wherein when the container is in the closed condition, the flange clamping area forms a seal with at least the flange by exerting inward pressure against the flange.

In one embodiment, the flange clamping area can also seal with the open end of the container by exerting pressure on the open end of the container. In a still further embodiment, the flange clamping area can seal with the inner surface of the container body by exerting pressure outwardly against the inner surface of the body.

The present inventor has determined that the provision of a flange that extends at least outwardly and towards an and of the body distal the open end allows for an inward pressure to be exerted on the flange, such that a seal is formed with at least the outer surface of the flange. This sealing arrangement provides excellent sealing performance between the closure and the body.

In one embodiment of this aspect, the flange can have a frusto-conical portion. In another embodiment, the flange can have a portion that extends substantially parallel to the container body. In a still further embodiment, the flange can have a free end embedded in or in abutment with the closure attachment means. In a still further embodiment, the flange can abut or be integral with the body of the container proximate its open end. In yet a still further embodiment, the flange can have an inwardly extending portion distal the open end of the container, the inwardly extending portion having an end proximate to or in abutment with the container body.

The flange clamping area preferably comprises an abutment surface that, when the container is brought to the closed condition, comes into face-to-face relationship with the outer surface of the flange. The abutment surface is preferably positioned so as to exert an inward pressure against the flange so forming an hermetic seal with the container. Where the flange shape is modified in a particular embodiment, the abutment surface is also modified to ensure the provision of the face-to-face relationship between the abutment surface and the flange when the container is brought to the closed condition.

In one embodiment, the flange clamping area can be provided by the provision of a groove in the underside of the top portion of the closure adjacent the skirt. The groove is preferably positioned relative to the skirt and is shaped so as to snugly receive the open end of the container body and at least a portion of the flange when the container is brought to the closed condition, with the surface of the groove serving to exert the required inward pressure against the flange and, preferably, also to exert pressure on the open end and inner surface of the container body.

The body of the container can be substantially cylindrical with the flange circumferentially surrounding the open end of the container. In this embodiment, the closure attachment means will preferably comprise an annular ring with the engagement means disposed on its outer surface.

According to a second aspect, the present invention consists in a container comprising:

a body having an open end;

a closure attachment means mounted over the open end of the container, the closure attachment means having an open end surrounded by a flange, the flange extending outwardly and towards an end of the closure attachment means distal the open end of the closure attachment means;

a closure comprising a top portion and a skirt extending outwardly from the top portion, an inner surface of the closure having a flange clamping area;

the closure and closure attachment means having complementary engagement means such that on movement of the closure in one direction relative to the closure attachment means the complementary engagement means may engage to bring the container to a closed condition and on movement of the closure in another direction relative to the closure attachment means the complementary engagement means may disengage to bring the container to an opened condition; and wherein when the container is in the closed condition, the flange clamping area forms a seal with at least the flange by exerting inward pressure against the flange.

In one embodiment of the second aspect, the flange clamping area can also seal with the open end of the closure attachment means by exerting pressure on the open end of the attachment means. In a still further embodiment, the flange clamping area can seal with an inner surface of the closure attachment means by exerting pressure outwardly against the inner surface of the attachment means.

In one embodiment of the second aspect, the flange can have a frusto-conical portion. In another embodiment, the flange can have a portion that extends substantially parallel to the closure attachment means. In a still further embodiment, the flange can have a free end embedded in or in abutment with the closure attachment means. In a still further embodiment, the flange can abut or be integral with the closure attachment means proximate its open end. In yet a still further embodiment, the flange can have an inwardly extending portion distal the open end of the closure attachment means, the inwardly extending portion having an end proximate to or in abutment with the closure attachment means.

The flange clamping area in the second aspect preferably comprises an abutment surface that, when the container is brought to the closed condition, comes into face-to-face relationship with the outer surface of the flange. The abutment surface is preferably positioned so as to exert an inward pressure against the flange so forming an hermetic seal with the closure attachment means. Where the flange shape is modified in a particular embodiment, the abutment surface is also modified to ensure the provision of the face-to-face relationship between the abutment surface and the flange when the container is brought to the closed condition.

In one embodiment of the second aspect, the flange clamping area can be provided by the provision of a groove in the underside of the top portion of the closure adjacent the skirt. The groove is preferably positioned relative to the skirt and is shaped so as to snugly receive the open end of the closure attachment means and at least a portion of the flange when the container is brought to the closed condition, with the surface of the groove serving to exert the required inward pressure against the flange and, preferably, also to exert pressure on the open end and inner surface of the closure attachment means.

The closure attachment means in the second aspect can be substantially cylindrical with the flange circumferentially surrounding the open end of the attachment means. In this embodiment, the closure attachment means will preferably comprise an annular ring with the engagement means disposed on its outer surface.

In the above aspects, the closure can have a top planar surface, the top planar surface having an upwardly extending annular ring adapted to allow the closure to be slidably engaged with the distal end of the container body when the closure is removed from the open end of the container body. The provision of the annular ring is particularly advantageous as it provides a convenient means of readily locating the closure on the bottom of the container following its removal from the open end. The upwardly extending annular ring can in turn have a resiliently flexible web extending outwardly therefrom. The flexibility of the outwardly extending web is preferably such that it does not interfere with the ready stacking of containers having the closure one above the other, for example, on a display shelf or in storage but is sufficiently rigid so that it will hold a removed closure on the distal end of the container following its removal from the open end.

The engagement means on the outer surface of the annular ring in each of the above aspects preferably comprises a screw thread adapted to engage with a complementary screw thread on the inner surface of the skirt of the closure. The screw thread on the closure can comprise a single-start or multi-start screw thread.

In each of the above aspects, the skirt of the closure can also have a free end with the free end having connected thereto a tamper evident band, such as is known in the art. The tamper evident band can be adapted to engage with a bead or similar protuberance on the outer surface of the closure attachment means below the engagement means just as the closure is disengaged from the container. The engagement of the band with the bead will preferably lead to some visual effect such as the band being torn from the skirt thereby alerting potential users or consumers that the container has already been opened.

The closure, body and/or annular ring in each of the above aspects can each be made of a metal, a plastic material, or a combination of both materials. In the second aspect, the container can also be made of other materials such as a glass or a ceramic. The body and top portion of the closure can be formed from or lined with thermoplastics barrier sheet material. The body and top portion may also be formed from a metal such as aluminium or steel. The barrier sheet material can be extruded multi-layer sheet that contains one or more layers which are resistant to the permeation of at least oxygen and water vapour. The barrier sheet material preferably comprises at least one polycarbonate layer and at least one amorphous polyethylene terephthalate layer or, alternatively, the barrier sheet may comprise at least two layers of polypropylene and at least one layer of ethylene vinyl alcohol. When the amorphous polyethylene terephthalate layered structure is utilised it can comprise 90% of a 200 to 1200 micron total layer thickness of the barrier sheet. If necessary, the top portion of the closure can have a number of strengthening ribs on its upper or lower surface.

In each of the above aspects, the closure attachment means and the skirt portion of the closure can be moulded from polypropylene. In one embodiment, the annular ring can be formed integrally with the body.

The container according to this aspect can be used to store food products, including solids, liquids and solid/liquid combinations. The containers can also be used to store other products where degradation of the products is undesirable, including chemicals, pharmaceuticals, paints, and the like.

According to a third aspect, the present invention consists in a closure attachment means for mounting to an open end of a container, the closure attachment means comprising a retaining portion for sealingly retaining the closure attachment means to the open end of the container, engagement means that may be engaged with complementary engagement means on a closure, and a first end surrounded by a flange, the flange extending outwardly and towards an end of the body distal the first end of the closure attachment means, the retaining portion including a first portion having a surface adapted to abut one surface of the container and a second portion adapted to engage with the open end and the other surface of the container.

For many materials it is not possible or it is at least difficult to readily provide an engagement means on a container that allows a closure to be readily sealingly engaged to the container. The closure attachment means according to the third aspect of the invention allows a closure to be readily and sealingly attached to a container without requiring any or at least significant modification of the container to which it is to be attached.

In one embodiment of the third aspect, the flange can have a frusto-conical portion. In another embodiment, the flange can have a portion that extends substantially parallel to the closure attachment means. In a still further embodiment, the flange can have a free end embedded in or in abutment with the closure attachment means. In a still further embodiment, the flange can abut or be integral with the closure attachment means proximate its first end. In yet a still further embodiment, the flange can have an inwardly extending portion distal the open end of the closure attachment means, the inwardly extending portion having an end proximate to or in abutment with the closure attachment means.

In one embodiment of the third aspect, the retaining means of the closure attachment means is arranged to be mounted to the open end of a container having a cylindrical body. The closure attachment means can comprise an annular portion that can be disposed about the open end of the container. In the third aspect, the second portion is preferably substantially continuous and extends about the circumference of the annular portion.

The annular member preferably has an outer and inner surface, with the second portion and engagement means being each disposed on the outer surface. In this embodiment, the engagement means is preferably disposed radially inwardly of the second portion. The radially inward disposition of the engagement means is preferably such that an outer surface of the closure on engagement with the attachment means does not extend outwardly beyond the outer dimensions of the closure attachment means.

In another embodiment of the third aspect, the engagement means is disposed on the inner surface of the annular member. In this embodiment, the engagement means, when the annular member is retained on a container, can extend inwardly. A closure having a complementary engagement means can then be attached to the container and, if desired, not extend outwardly beyond the outer dimensions of the open end of the container.

According to a fourth aspect, the present invention consists in a closure attachment means for mounting to an open end of a container, the closure attachment means comprising a retaining portion for sealingly retaining the closure attachment means to the open end of the container and engagement means that may be engaged with complementary engagement means on a closure and so bring the container body to a closed condition, the retaining portion including a first portion having a surface adapted to abut one surface of the container and a second portion adapted to engage with the open end and the other surface of the container body, and the engagement means including a tapering protrusion adapted to sealingly engage in a complementary recess in a closure when the container is brought to the closed condition by a closure.

In one embodiment of the fourth aspect, the tapering protrusion extends outwardly from an end of the closure attachment means distal the retaining portion. The closure attachment means can also comprise an annular portion having an inner and outer surface. In a preferred embodiment, the tapering protrusion is continuous and extends fully about the closure attachment means.

In both the third and fourth aspects, the engagement means preferably comprises a screw thread arranged to engage with a complementary screw thread on a closure. The screw thread on the closure can comprise a single-start or multi-start screw thread.

In the third and fourth aspects, the container and the top portion of the closure can be formed from a metal such as aluminium or steel or other materials such as a glass or a ceramic. The container and top portion can also be formed from or lined with thermoplastics barrier sheet material or the container may also be formed either in whole or part from a paper product, such as cardboard. The thermoplastics barrier sheet material can be extruded multi-layer sheet that contains one or more layers which are resistant to the permeation of at least oxygen and water vapour. The barrier sheet material preferably comprises at least one polycarbonate layer and at least one amorphous polyethylene terephthalate layer or, alternatively, the barrier sheet may comprise at least two layers of polypropylene and at least one layer of ethylene vinyl alcohol. When the amorphous polyethylene terephthalate layered structure is utilised it can comprise 90% of a 200 to 1200 micron total layer thickness of the barrier sheet material.

In the third and fourth aspects, the closure attachment means and the skirt portion of the closure can be moulded from polypropylene or formed from a metal such as stainless steel or aluminium. The seal between the retaining means and the open end of the container may be achieved by an interference fit, ultrasonic welding, adhesives or other suitable methods which meet the requirements of the formation of a seal.

According to a further aspect, the present invention consists in a container having the closure attachment means according to the third or fourth aspects of the present invention mounted thereon.

The container can be used to store food products, including solids, liquids and solid/liquid combinations. The container can also be used to store other products where degradation of the products is undesirable, including chemicals, pharmaceuticals, paints, and the like.

BRIEF DESCRIPTION OF THE DRAWINGS

By way of example only, preferred embodiments of the aspects of the present invention are now described with reference to the accompanying drawings, in which:

FIG. 2*a* is a partial cross-sectional view of another container having a still further modified flange for use in the one aspect of the present invention;

PREFERRED MODE OF CARRYING OUT THE INVENTION

FIGS. 1–4*c* are directed to one aspect of the present invention.

Figure 1:
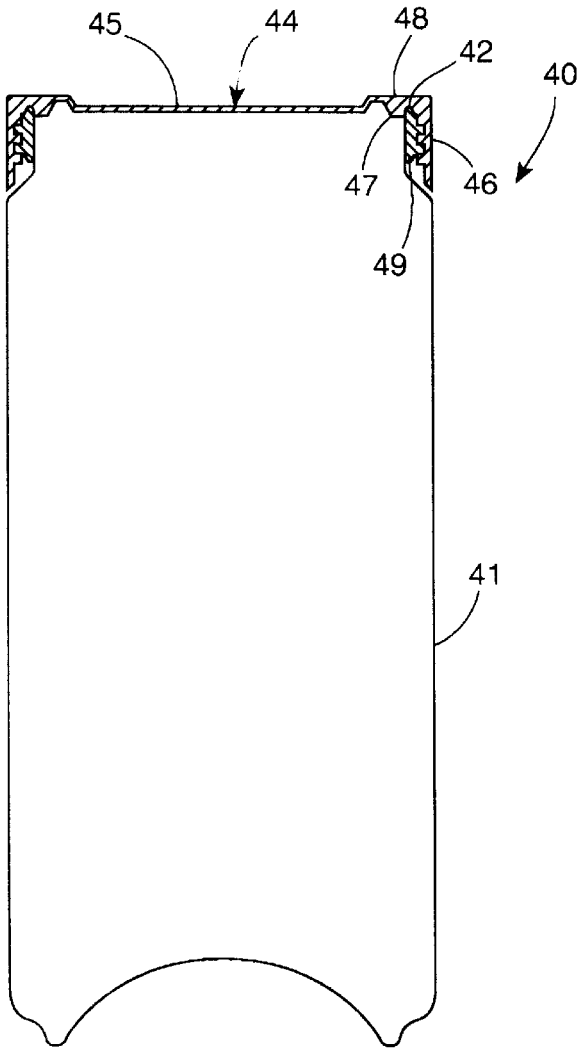
FIG. 1 is a cross-sectional view of one aspect of a container/closure combination according to the present invention.
Figure 1A:
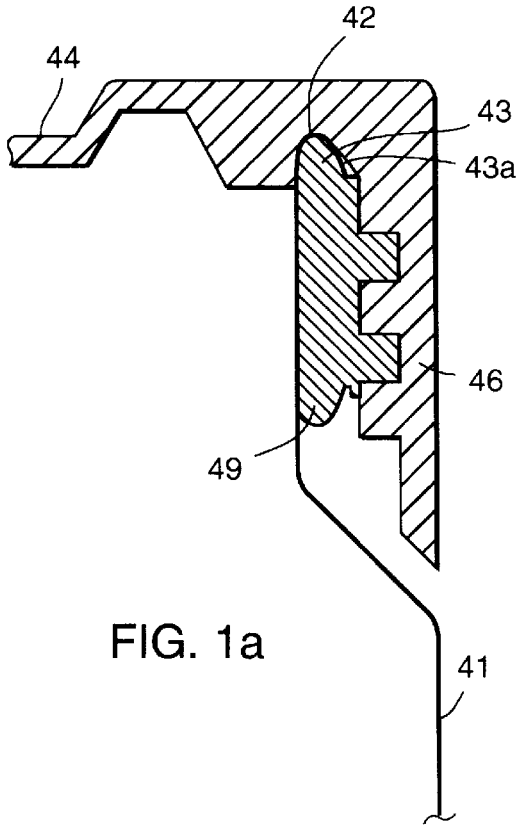
FIG. 1*a* is an enlarged partial cross-sectional view of the container depicted in FIG. 1.
Figure 2:
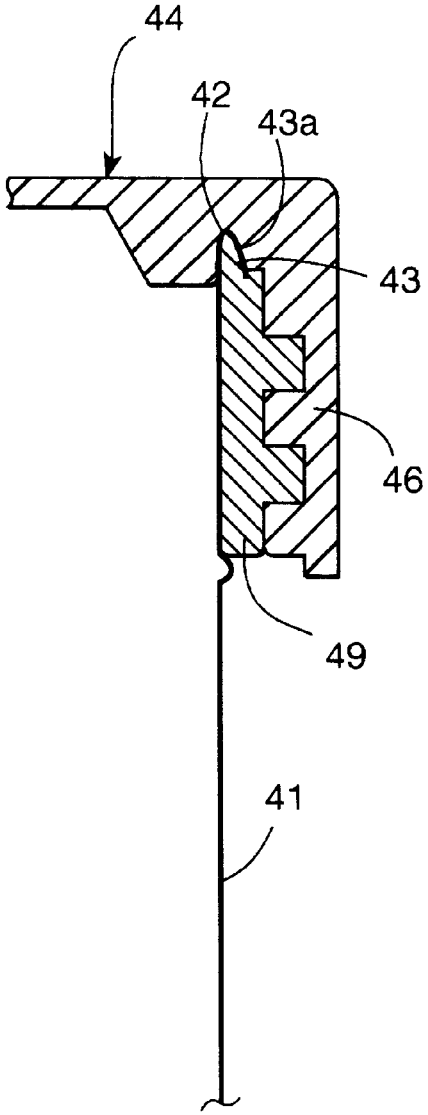
FIGS. 2 and 2*a* are partial cross-sectional views of containers having modified flanges to that depicted in FIGS. 1 and 1*a;*

In this aspect, the container, generally depicted as 40, has a cylindrical aluminium body 41 having a open end 42 surrounded by a flange 43 which extends outwardly and downwardly from the open end 42. As is depicted in FIGS. 1 and 2, the flange 43 has an outer surface 43*a* and can comprise or include a frusto-conical portion extending downwardly from the open end 42 and which is embedded in the thread ring 49.

Figure 2A:
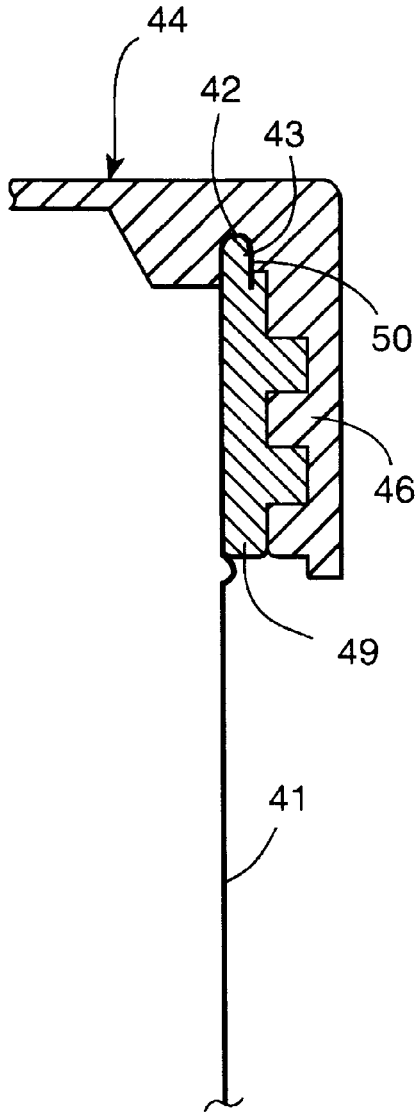

In another embodiment, such as is depicted in FIG. 2*a*, the flange 43 extends outwardly and then downwardly such that a portion 50 is substantially parallel to the body 41 of the container.

Figure 3:
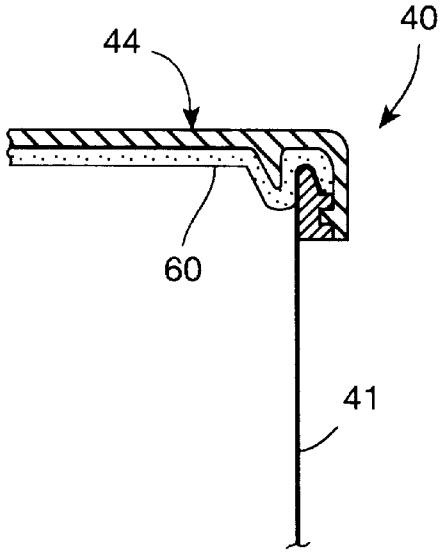
FIG. 3 is a partial cross-sectional view of a modified version of the container/closure combination depicted in FIG. 1.
Figure 3A:
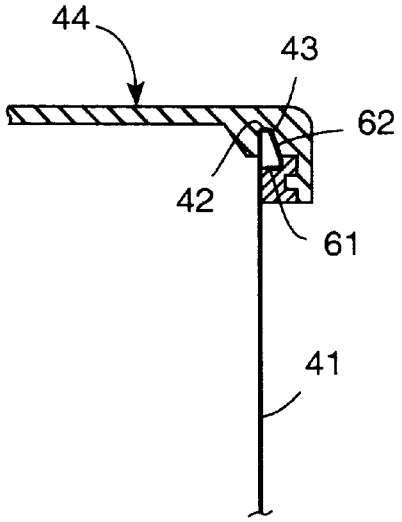
FIGS. 3*a*–3*e* are partial cross-sectional views of still different flange arrangements for use in the one aspect of the present invention.
Figure 3B:
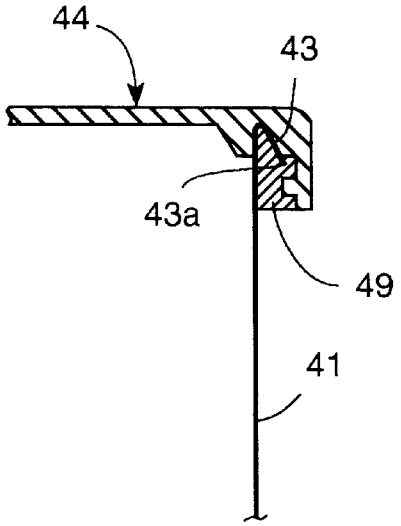
Figure 3C:
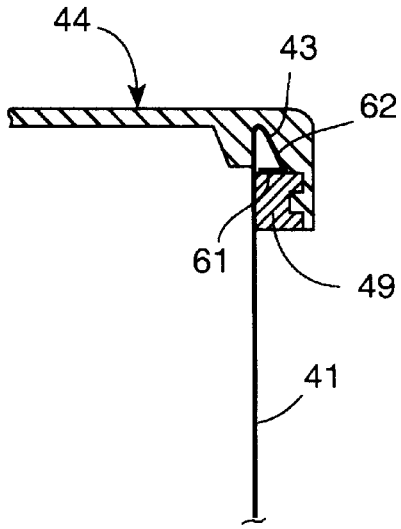

In further embodiments, such as depicted in FIGS. 3*a* and 3*c*, the flange 43 can have a first portion 62 that extends outwardly and downwardly and a second portion 61 integrally connected to the end of the first portion 62 and extending inwardly therefrom. The inward extension of the second portion 61 serves to conceal the free end of the flange 43 thereby allowing a person to safely drink directly from the container 41 on removal of the closure 44 therefrom.

Alternative dispositions of the flange 43 can be envisaged, including the rounded flange 43 depicted in FIG. 3*d*, which is discussed in more detail below. The free end 43*a* of the flange 43 can also be embedded in the annular ring 49 as depicted in FIG. 3*b*.

Figure 3D:
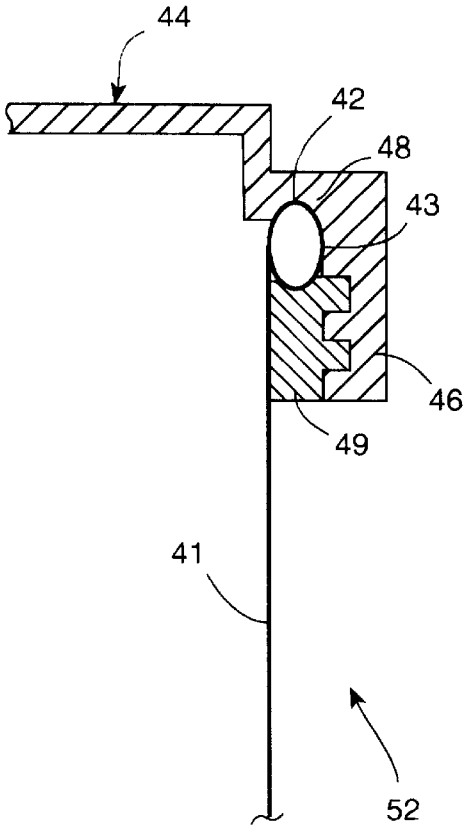
Figure 3E:
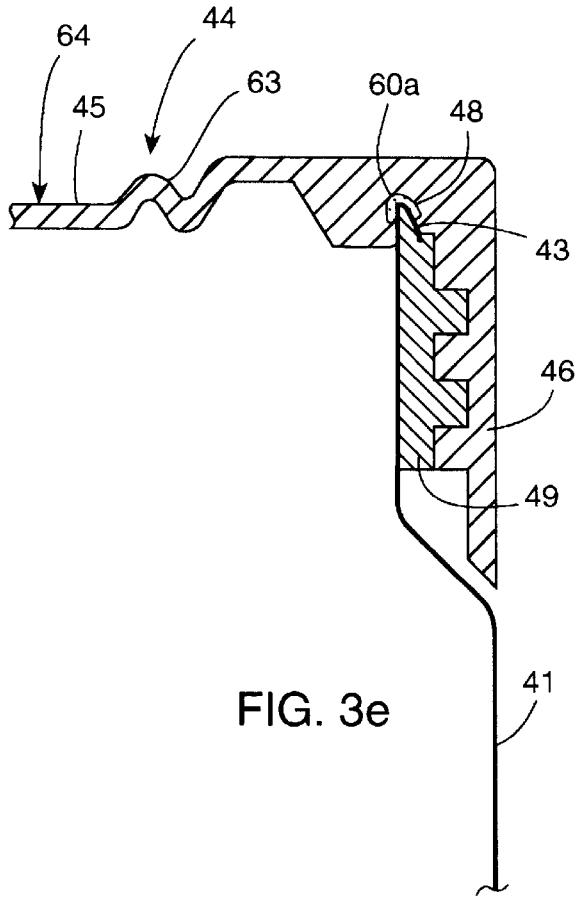
Figure 3F:
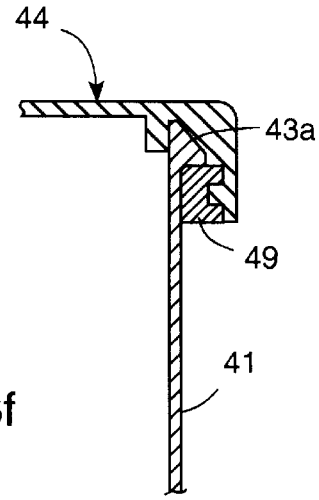
FIG. 3*f* is an enlarged partial cross-sectional view of a still different embodiment of a container according to the present invention.

In a further embodiment depicted in FIG. 3*f*, the container is formed from glass with the flange 43, having the surface 43*a*, being formed integral with the container 41 proximate its open end 42.

The body 41 can be fabricated from a plastics material, a metal, a glass or a ceramic. In the embodiments depicted in FIGS. 1–3*e*, the body 41 is fabricated from aluminium sheet having a thickness of approximately 0.125 mm and is a typical 375 mL aluminium beverage container. The use of a container fabricated from an alternative material, such as steel or glass (eg. see FIG. 3*f*), can be readily envisaged. The container 41 could contain an alcoholic beverage such as beer or a carbonated soft drink. By being able to completely remove the closure 44 from the aluminium can depicted in FIGS. 1–3*e* or the glass container depicted in FIG. 3*f*, a drinker can drink the beverage in a manner similar to that used when drinking a beverage poured into and served in a glass. This is especially advantageous for beer drinkers as much of the pleasant aroma of the beer cannot be smelled by the drinker when drinking from a traditional can or bottle.

As depicted in FIG. 1, the closure 44 can be mounted to the open end 42 of the body 41. The closure 44 has a planar portion 45 and a skirt 46 connected by a flange clamping portion 48 having an underside that is adapted to seal with the open end 42 and the outer surface 43*a* of the flange 43. The flange clamping portion 48 also comprises an annular wedge 47 which seals with the inner surface of the body 41. In FIG. 1, the outside diameter of the closure 44 is 66 mm and the height of the skirt is 14 mm. A similar arrangement for the container having the flange 43 depicted in FIG. 2*a* can also be readily envisaged.

Disposed beneath the flange 43 is an annular thread ring 49 that is mounted around the body 41. While depicted as a separate member, the thread ring 49 in another embodiment could comprise an integral portion of the body 41. The outer surface of the thread ring 49 has a multi-start screw thread adapted to engage with a complementary multi-start screw thread on the inner surface of the skirt 46.

On attachment of the closure 44 to the body 41, the complementary screw threads engage with each other and the flange clamping portion 48 is drawn into tight abutment with the open end 42 of the body 41. The wedge 47 also directs radially outward pressure on the body 41 while the skirt 46 directs radially inward pressure on the flange 43. This combination of the sealing pressure at the open end 42 together with the radially inward and outward pressure exerted by the flange clamping portion 48 lead to the formation of a seal that can withstand the high pressures that can be generated during filling, processing, transportation and storage of containers for storing foods or liquids, including carbonated beverages.

The closure 44, including the thread ring 49, are fabricated from polypropylene in the depicted embodiment, however, other suitable materials, including metal, can be readily envisaged. As depicted in FIG. 3, the closure can also have a sealing liner 60 of barrier sheet material covering its lower surface. A sealing gasket formed from a soft plastics material, such as polyethylene, polyurethane or latex, can be used to further improve the sealing characteristics of the closure 44 when on the body 41. For example, a sealing gasket 60*a* can be present on the lower surface of the closure 44 at the flange clamping portion 48 where it engages with the flange 43, such as is depicted in FIG. 3*e*.

An alternative embodiment 52 of the present invention is depicted in FIG. 3*d*. In this embodiment, the flange 43 is rounded over with the flange clamping portion 48 forming a seal with the outer surface of the flange 43 and the open end 42. In this embodiment, the container could also be sealed with a fracturable aluminium foil membrane if desired. The aluminium foil membrane can be provided to allow a person on opening of the container to determine if the contents of the container 41 have been tampered with.

Figure 4A:
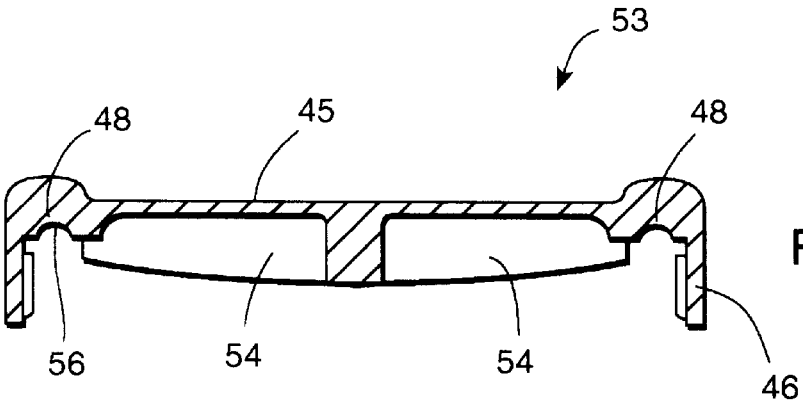
FIG. 4*a* is a cross-sectional view of a modified closure for use in the one aspect of the present invention.
Figure 4B:
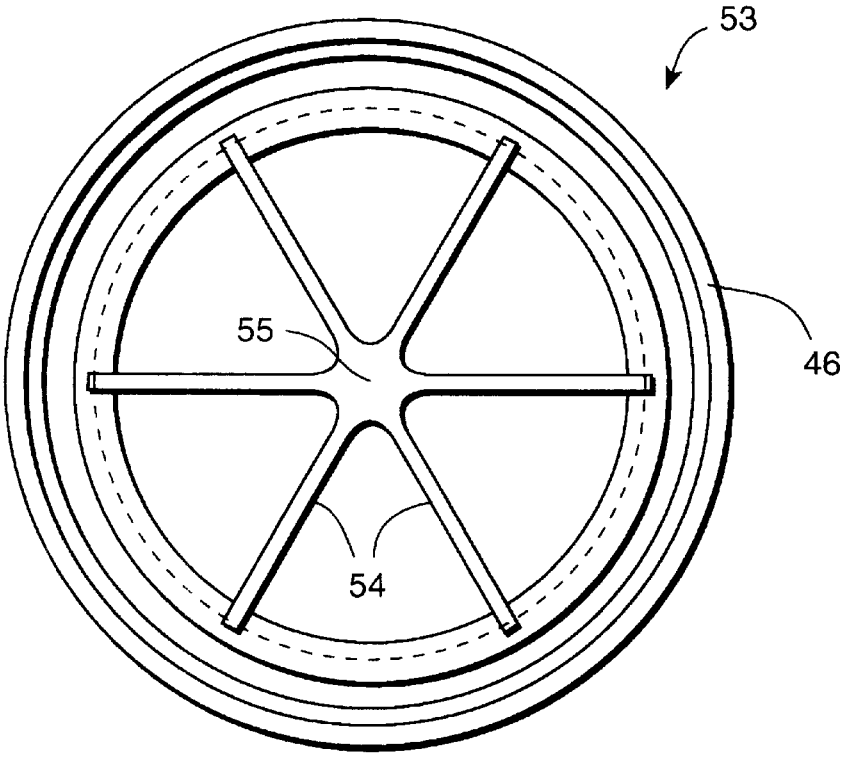
FIG. 4*b* is an underneath plan view of the closure of FIG. 4*a;*
Figure 4C:
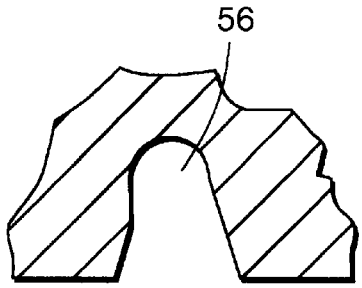
FIG. 4*c* is an enlarged partial cross-sectional view of the flange clamping portion of the closure depicted in FIGS. 4*a* and 4*b;*

An alternative closure 53 for mounting to the container 41 is depicted in FIGS. 4*a*, 4*b* and 4*c*. In this closure 53, the underside of the planar portion 45 has six ribs 54 extending outwardly from a central post 55, that extends downwardly from the underside of the planar portion 45, to proximate the flange clamping portion 48. The ribs 54 serve to strengthen the planar portion 45 of the closure 53 so reducing deformation of this portion of the closure when used to seal a container under relatively high pressure. In this embodiment, the flange clamping portion 48 surrounds a groove 56 that is adapted to surround the flange 43 and open end 42 of the container 41 on attachment thereto.

As is depicted in FIG. 3*e*, the planar portion 45 of the closure 44 can have a zone weakness 63 defining a "pop-out" portion 64 so that the closure can compensate for transient increases in pressure in the container. This has particular application for containers used to store foods. The pop-out portion 64 has the advantage of helping to preserve integrity of the seal made by the closure with the container. It further allows the thickness of the walls of the container to be decreased without a significant decrease in overall container strength.

Figure 6:
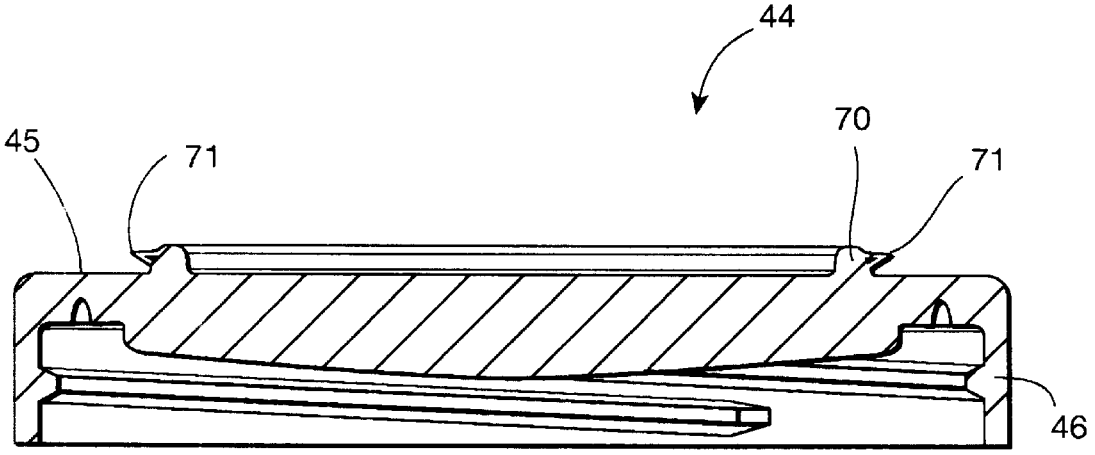
FIG. 6 is a cross-sectional view of another closure that can be used in the present invention.

In a still further embodiment of the closure 44, the top surface of the planar portion 45 can be modified so that the closure can accommodate the base of the container above thereby improving the stackability of the containers. For example, FIG. 6 depicts a closure 44 having an upwardly extending annular ring 70 formed integrally with the top surface of the closure. The web 70 is firstly dimensioned to allow the bottom end of another container to be easily stacked above the container having the closure. It is also dimensioned to allow the closure, following its removal of the container, to be slid over the bottom end of the container. This provides a convenient location for the closure following removal in case the user may wish to re-seal the container rather than consume or use all of the products contained therein. The annular ring 70 further has a resiliently flexible continuous annular web 71 extending outwardly therefrom. The flexibility of the web 71 is such that it does not interfere with the ready stacking of containers having the closure one above the other but is sufficiently rigid that will hold a removed closure on the base of the container. A person can, accordingly, open the container by removing the closure 44 and then for convenience attach the closure 44 to the base of the container using the ring 70 and the web 71.

While the depicted embodiments are directed to containers for the storage of food, it can be readily envisaged that the embodiments could be directed to other goods, including chemicals, pharmaceuticals and paints.

Figure 5A:
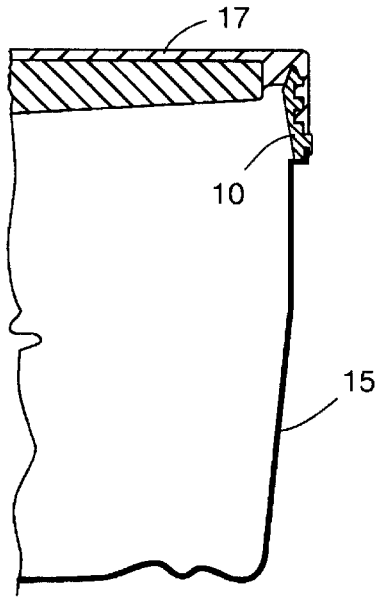
FIG. 5*a* is a partial cross-sectional view of a closure attachment means according to a further aspect of the present invention depicted mounted on a container body.
Figure 5B:
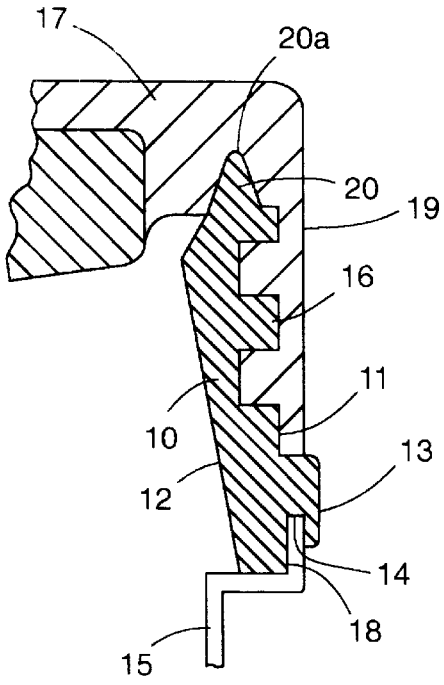
FIG. 5*b* is an enlarged cross-sectional view of the closure attachment means.
Figure 5C:
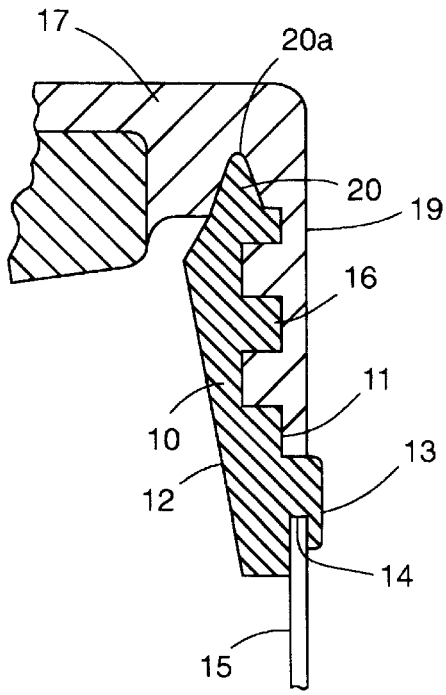
FIG. 5*c* is an enlarged cross-sectional view of the closure attachment means mounted to a container having a different open end configuration to that depicted in FIGS. 5*a* and 5*b*.

FIGS. 5*a* to 5*c* are directed to a further aspect of an invention according to the present invention. In this aspect, the invention comprises an annular ring generally depicted as 10. The ring 10 has an outer surface 11 and an inner surface 12. Disposed on the outer surface 11 is a continuous hook member 13 that extends about the circumference of the ring 10. As is more clearly depicted in FIG. 5*b*, the hook 13 is adapted to slide over and frictionally engage with the free end 14 of a container body 15. The hook 13 may be sealed to the free end 14 of the body 15 by an interference fit, ultrasonic welding, adhesives or any other suitable method that will meet the requirement of providing a seal between the ring 10 and body 15. Below the hook 13, the ring 10 has substantially cylindrical outer surface 18 that can abut the inner surface of the body 15 proximate its open end and so provide further support for the ring 10 on the body 15.

Also disposed on the outer surface 11 is a screw thread 16 that is adapted to engage with a complementary screw thread on the inner surface of the skirt 19 of the closure 17. The screw thread 16 is disposed radially inwardly of the hook 13 so that, if desired and as is depicted in FIG. 5*c*, the outer surface of the skirt 19 does not extend radially outwardly beyond the outer dimensions of the body 15. Alignment of the skirt 19 with the container 15 is desirable in many circumstances as it ensures that a minimum area is taken by the packaging when being transported or displayed. The top end of the ring 10 has a tapering protrusion 20 adapted, when a closure 17 is attached to the ring 10, to engage in a recess 20*a* in the underside of the closure 17. As the closure 17 is screwed on to the ring 10, the surfaces of the recess 20*a* exert pressure on the surfaces of the protrusion 20 and so form a hermetic seal.

The body 15 can be fabricated from a metal, plastics or cardboard material and/or a combination or composite of such materials. In the embodiment depicted in FIGS. 5*a* to 5*c*, the body 15 is fabricated from a thermoplastics multi-layer sheet having good barrier properties, making the container suitable for preservation of oxygen-sensitive foods for extended periods. The multi-layer barrier sheet is selected to protect the products against loss of flavour and loss of quality attributes due to transmission of moisture and various gases in either direction through the wall of the container. A particular barrier sheet that can be used in this depicted aspect comprises a co-extruded sheet comprising at least three layers, each surface layer being of amorphous polycarbonate having a melt flow index of 8–12 g/10 min (ASTM Method D1238 condition 0) and the enclosed third layer being of amorphous polyethylene terephthalate homopolymer or copolymer ("APET") having intrinsic viscosity in the range 0.6 to 0.05 (Goodyear method No. R-100f). The total thickness of the layers may be typically in the range 200 to 1200 microns in which typically the APET layer comprises about 90% of the total thickness. The barrier sheet may comprise additional layers.

An alternative barrier sheet of slightly lower temperature resistance that could be employed in the depicted embodiment is a five layer co-extruded thermoplastics structure having internal and external layers of polypropylene contacted by layers of adhesive, each adhesive layer in turn contacting a relatively thin enclosed layer of ethylene vinyl alcohol. This material provides an excellent barrier to permeation transfer of water vapour, oxygen, nitrogen and carbon dioxide gases.

In this depicted aspect, the annular ring 10 and the closure 17 are fabricated from moulded polypropylene. These components can, however, also include more or less heat resistant olefine type thermoplastics such as polybutylene or high density polyethylene.

It can be readily envisaged that the skirt of the closure 17 could have a tamper evident band depending from its free end which would, when the closure 17 was attached to the body 15, engage under a bead on the body 15 or on the outer surface 11 of the ring 10 below the screw thread 16. On removal of the closure 17 from the body 15, the tamper evident band would engage with the bead and fracture either wholly or in part from the skirt of the closure so indicating removal of the closure 17 from the body 15.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A container comprising:

a body having an open end and a flange proximate the open end, the flange extending outwardly and towards an end of the body distal the open end;

a closure for the body comprising a top portion and a skirt extending outwardly from the top portion, an inner surface of the closure having a flange clamping area;

a closure attachment means mounted on the body proximate the flange;

the closure and closure attachment means having complementary engagement means such that on movement of the closure in one direction relative to the closure attachment means the complementary engagement means may engage to bring the container to a closed condition and on movement of the closure in another direction relative to the closure attachment means the complementary engagement means may disengage to bring the container to an opened condition; and wherein the flange clamping area comprises a groove in an underside of the top portion of the closure adjacent the skirt, the groove being shaped to snugly receive the open end of the container body and at least a portion of the flange when the container is brought to the closed condition, with a surface of the groove forming a seal with at least the flange by exerting inward pressure against the flange.

2. The container as defined in claim 1 wherein when the container is in the closed condition, the flange clamping area also seals with the open end of the container by exerting pressure on the open end of the container.

3. The container as defined in claim 1 wherein when the container is in the closed condition, the flange clamping area also seals with an inner surface of the container body by exerting pressure outwardly against the inner surface of the body.

4. The container as defined in claim 1 wherein the flange has a frusto-conical portion.

5. The container as defined in claim 1 wherein the flange has a portion extending substantially parallel to the container body.

6. The container as defined in claim 1 wherein the flange has a free end in abutment with the closure attachment means.

7. The container as defined in claim 1 wherein the flange has a free end embedded in the closure attachment means.

8. The container as defined in claim 1 wherein at least a portion of the flange is in abutment with the container body proximate the open end.

9. The container as defined in claim 1 wherein the flange has an inwardly extending portion distal the open end of the container, the inwardly extending portion having an end proximate to with the container body.

10. The container as defined in claim 1, wherein the container is used to store food products.

11. The container as defined in claim 1 wherein at least a portion of the flange is integral with the container body proximate the open end.

12. The container as defined in claim 1 wherein the flange has an inwardly extending portion distal the open end of the container, the inwardly extending portion having an end in abutment with the container body.

13. The container as defined in claim 1 wherein the closure and closure attachment means are molded from a plastics material.

14. The container as defined in claim 13 wherein the closure attachment means and the skirt portion of the closure are molded from polypropylene.

15. The container as defined in claim 1 wherein the body of the container is substantially cylindrical.

16. The container as defined in claim 15 wherein the closure attachment means comprises an annular ring having the engagement means on its outer surface.

17. The container as defined in claim 16 wherein the engagement means on the outer surface of the annular ring is a screw thread and the engagement means on the inner surface of the closure is a screw thread, the screw thread on the annular ring being engageable with the complimentary screw thread on the inner surface of the skirt of the closure.

18. The container as defined in claim 15 wherein an upper surface of the top portion of the closure has an upwardly extending annular ring adapted to allow the closure to be slidably engaged with the distal end of the container body when the closure is removed from the open end of the container body.

19. The container as defined in claim 18 wherein the upwardly extending annular ring has a resiliently flexible web extending outwardly therefrom.

* * * * *